United States Patent [19]

Berthelsen

[11] Patent Number: 4,540,396

[45] Date of Patent: Sep. 10, 1985

[54] APPARATUS FOR FOLDING PAPER SACKS TO Z SHAPE

[75] Inventor: Ernst R. Berthelsen, Terndrup, Denmark

[73] Assignees: Bates Ventilsakke Co. A/S, Norresundby, Denmark; Windmoller & Holscher, Fed. Rep. of Germany

[21] Appl. No.: 487,875

[22] Filed: Apr. 22, 1983

[30] Foreign Application Priority Data

Apr. 22, 1982 [DE] Fed. Rep. of Germany ..... 3215006

[51] Int. Cl.[3] ..... B65H 45/22

[52] U.S. Cl. ..... 493/447; 493/399

[58] Field of Search ..... 493/397, 399, 421, 441, 493/446, 447, 455

[56] References Cited

U.S. PATENT DOCUMENTS 3,002,431 10/1961 Rawe ..... 493/399

*Primary Examiner*—W. D. Bray

*Attorney, Agent, or Firm*—Fleit, Jacobson, Cohn & Price

[57] ABSTRACT

Apparatus for folding paper sacks to a Z shape about transverse fold lines comprises scoring wheels for defining the fold lines, folding blades and folding means consisting of folding bars for turning the sacks about the folding blades. A first double belt conveyor clampingly engages each sack near its base or filling aperture and conveys it continuously through the folding means. Two parallel shafts mounted in the machine frame in a vertical plane transverse to the conveying direction each carry two spaced co-operating scoring wheels which provide the passing sacks with scoring in opposite senses. A second double belt conveyor provided parallel to the first engages the sacks at the opposite end, has a length equal to the scoring and holds each sack while passing through the scoring wheels. A third double belt conveyor adjoining the second and parallel to the first clamps each sack between the first double belt conveyor and the scoring facing same during folding about this scoring. A first folding blade parallel to the third double belt conveyor has its folding edge disposed near the first scoring and a first folding bar has its rear end below the plane of the rear end of the first folding blade and the front end overlapping the front zone of the first folding blade. A fourth double belt conveyor adjoining the third clamps the sack in the region of the first fold. A second folding blade parallel to the fourth double belt conveyor has its folding edge near the second scoring above the first fold. A folding bar is provided which turns the free sack portion over the second folding blade.

12 Claims, 7 Drawing Figures

APPARATUS FOR FOLDING PAPER SACKS TO Z SHAPE

The invention relates to an apparatus for folding essentially planar articles, such as paper sacks or the like, to a Z shape about transverse fold lines, comprising scoring wheels for defining the fold lines, folding blades and folding means consisting of folding bars for turning the sacks about the folding blades.

An apparatus for turning inwardly the side flaps of the expanded bases of cross-bottom sacks and comprising scoring wheels for defining the fold lines, folding blades and folding bars for turning the side flaps about the folding blades is known for example from DE-GMS 69 29 888.

After manufacture, paper sacks are conventionally stacked, tied and deposited on pallets for transporting the sacks. The size of the pellets must correspond to the length and width of the flattened sacks. The pallets therefore take up unnecessarily large storage space because the height of the stacks of paper sacks is determined by the height of the superposed cross-bottoms. The reason for this is that many layers of sack material are superposed in the base regions as compared with the central regions of the sacks. Consequently, in stacks of cross-bottom sacks the opposed sides of the stack stand up whereas the central region of the stack sags, this leading to a waste of space and untidy stack shapes.

The invention is based on the recognition that stacks of cross-bottom sacks can be formed to be more compact, take up less storage space, be more stable and tidier if the zone of the flattened sacks between the cross-bottoms at the ends is folded to a Z shape so that the double transversely folded sacks will have a height at their central region corresponding to the height at the base regions.

It is therefore a purpose of the invention to solve the above-described problem and to provide an apparatus for folding particularly cross-bottom sacks to a Z shape so that the sacks can be piled up to form compact stacks with aligned edges.

According to the invention, the apparatus of the invention permits the central regions of cross-bottom sacks to be folded to a Z shape intermediate the bases at the ends and in the sequence of manufacture of the sacks so that their lengths are practically halved and it is possible to stack the sacks to form correspondingly smaller, stable and compact stacks.

One example of the invention will now be described in more detail with reference to the drawing, wherein.

Figure 3:
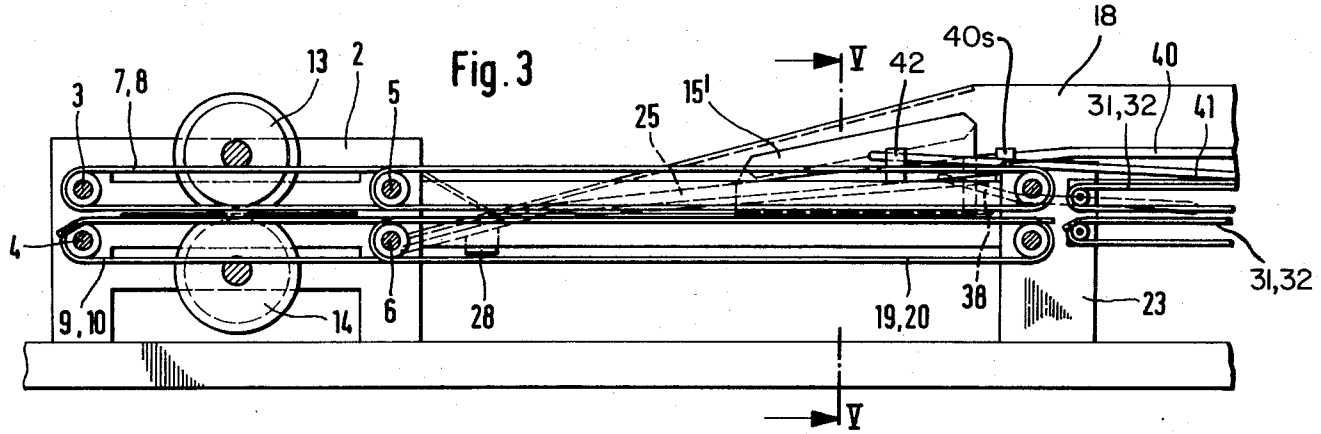
FIGS. 3 and 4 are respective side elevation views of the portions of the apparatus shown in FIGS. 1 and 2.
Figure 4:
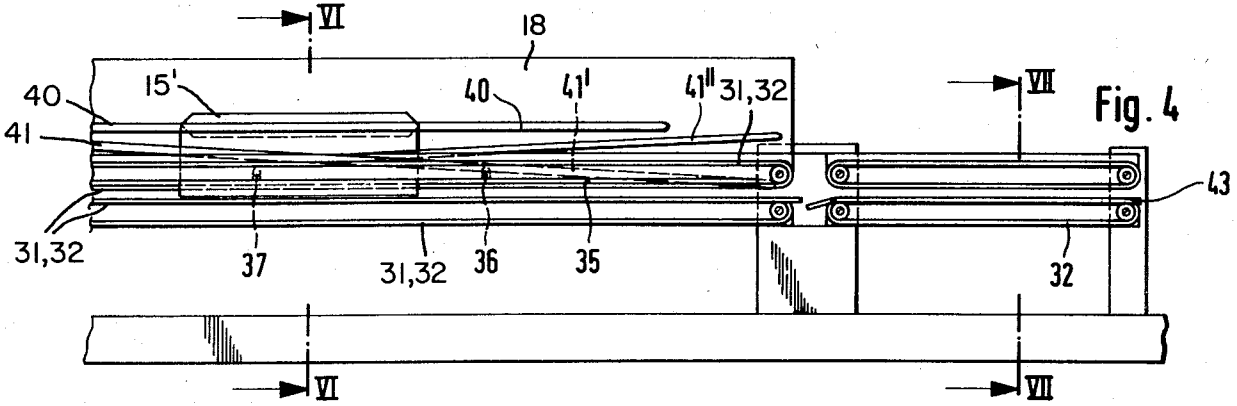
Figure 5:
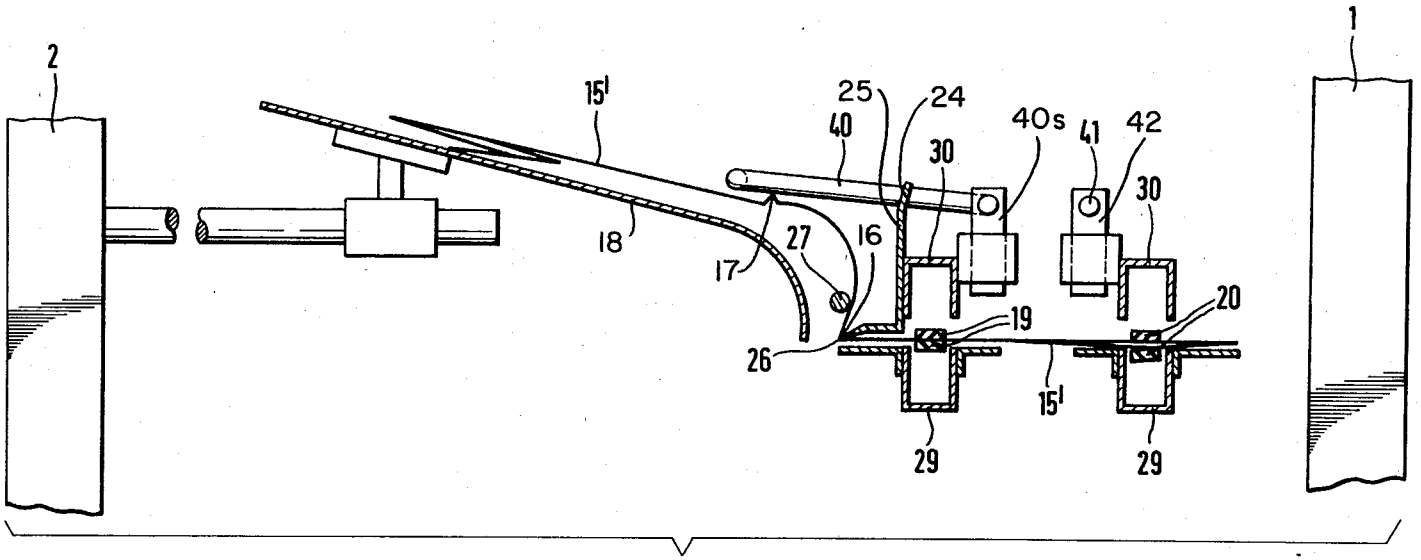
FIG. 5 is a section through the apparatus taken on the line V—V in FIG. 3.

Shafts 3, 4, 5 and 6 are mounted in side walls 1 and 2 of a machine frame, which is otherwise unnumbered. The shafts 3, 4, 5, and 6 carry unnumbered conveyor belt rollers over which endless conveyor belts 7, 8 and 9, 10 are disposed. Between the rotatable shafts 3, 4 and 5, 6, two further shafts 11 and 12 are mounted above each other in the machine frame side walls 1 and 2 and carry upper scoring discs 13 and lower scoring discs 14 so that essentially planar articles in the form of individual sacks 15 transported by the conveyor belts 7, 8, 9, 10 are provided by the scoring discs 13 and 14 with two spaced transverse scorelines or fold lines 16 and 17, which are formed to face in opposite directions upwardly and downwardly, respectively, as viewed in FIG. 3. Each thus prescored sack 15 thereafter travels onto a guide table 18 which supports essentially one half of the sack while essentially the other half of the sack is engaged by pairs of conveyor belts 19 and 20 supported in unnumbered rollers which are carried by the shafts 5 and 6 on the one hand and by two further shafts 21 and 22 on the other hand. More specifically, as shown in FIG. 5, the conveyor belts 19 and 20 engage the sack 15 on only one side of the scoreline 16, with the part of the sack on the opposite side of the scoreline free to move transversely to the path of travel of the sack during folding of the sack along the scoreline. At their ends remote from the wall 1, the shafts 21 and 22 are mounted in a support plate 23 which is best shown in FIG. 3.

Figure 1:
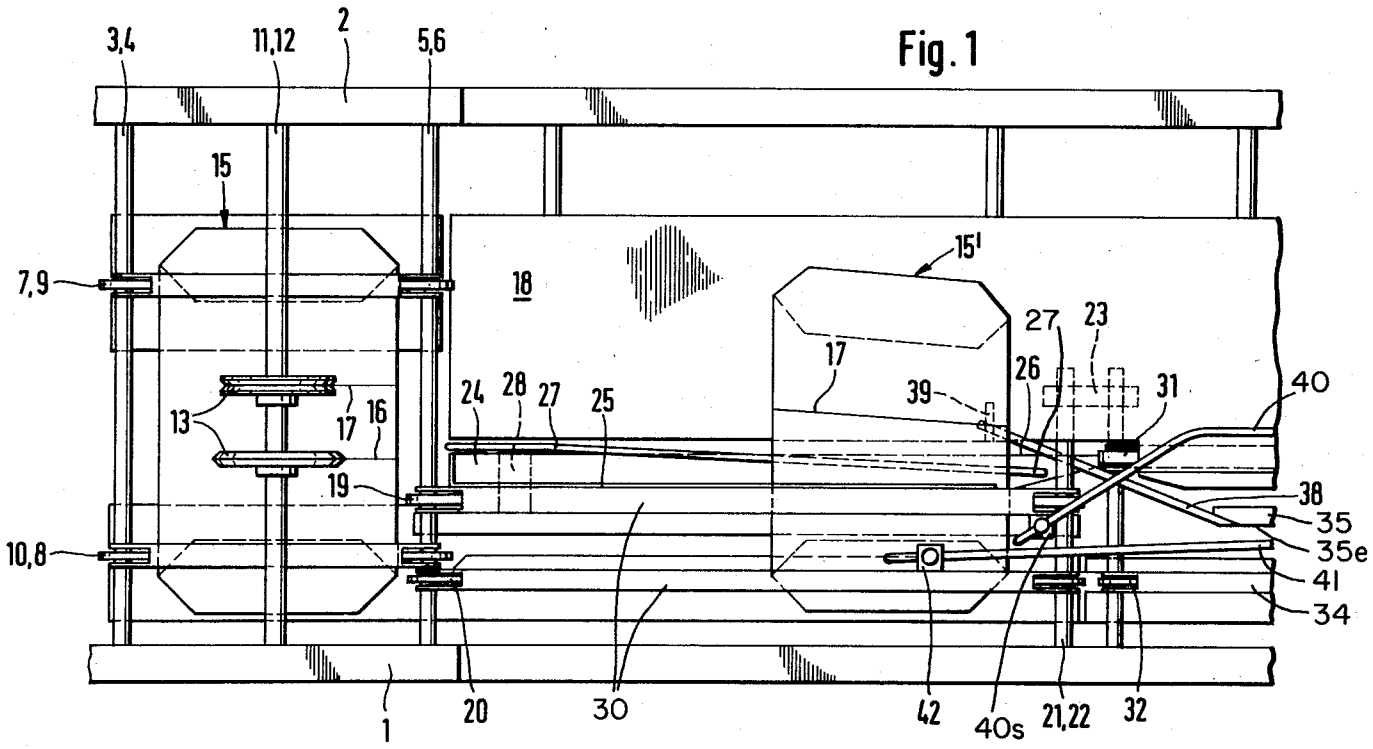
FIGS. 1 and 2 are plan views of adjacent portions of an apparatus for folding sheet-like articles, such as paper sacks, to a Z shape.

A right-angle guide plate 24 between the pair of conveyor belts 19 and the guide table 18 comprises a vertically upstanding supporting web 25 (best shown in FIG. 5) having a lower horizontal flange provided with an outer folding edge 26. It is about this folding edge 26 that the sack 15 is turned or folded in the region of its scoreline 16 by a guide bar 27 to produce a partially folded sack designated hereinafter by the reference number 15'. In relation to FIG. 1 and viewed in the conveying direction, the guide bar 27 extends from beneath the folding edge 26 and the guide plate 24 at the left-hand side of FIG. 1, and upwardly and above the guide plate and the folding edge; and towards the pair of conveyor belts 19 at the right-hand side of FIG. 1, for engaging and causing folding of the sack 15' upward about the folding edge as shown in FIG. 5. Turning of the sack 15' about the folding edge 26 in the region of the scoreline 16 by the guide bar 27 is assisted by the guide table 18 which, as is shown in FIGS. 3 to 6, extends from a horizontal position to rise to the inclined position shown in FIGS. 5 and 6. The guide bar 27 has only one end portion thereof secured by a support 28 to a cross-member (not shown) which interconnects the walls 1 and 2, with the remainder of the guide bar cantilevered from the support in the direction of conveying as shown in FIG. 1.

Folding of the sack 15 about the folding edge 26 by the guide bar 27 is clearly shown in FIG. 5. This figure also shows that the pairs of conveyor belts 19 and 20 are covered by upper and lower housing portions 29 and 30. Adjoining the end of the guide plate 24 in offset relationship to the conveyor belts 19, as shown in FIG. 1, there is a pair of conveyor belts 31 and adjoining the pair of conveyor belts 20 there is a pair of conveyor belts 32.

Figure 6:
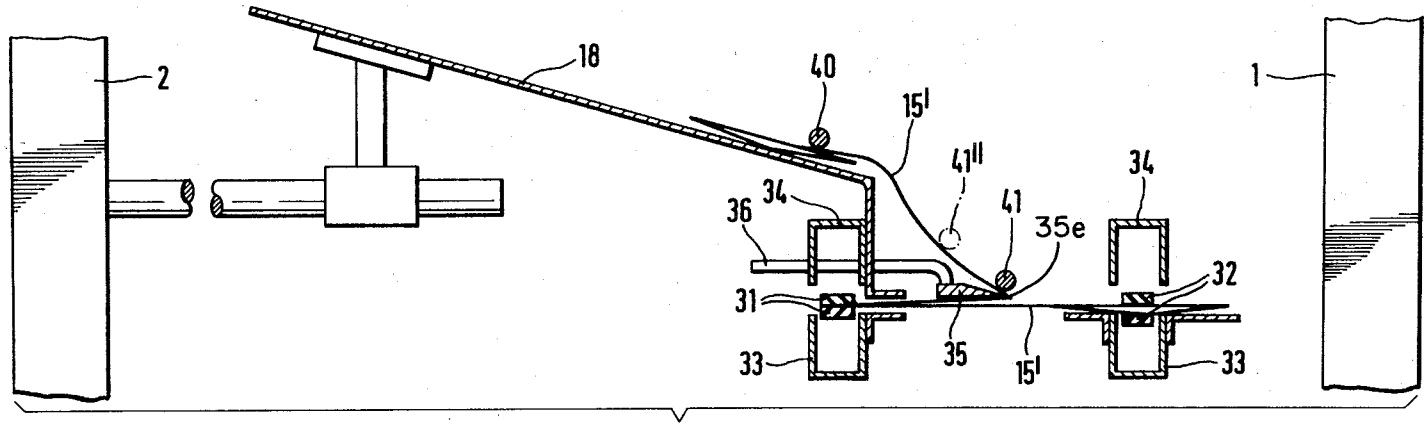
FIG. 6 is a section through the apparatus taken on the line VI—VI in FIG. 4
Figure 7:
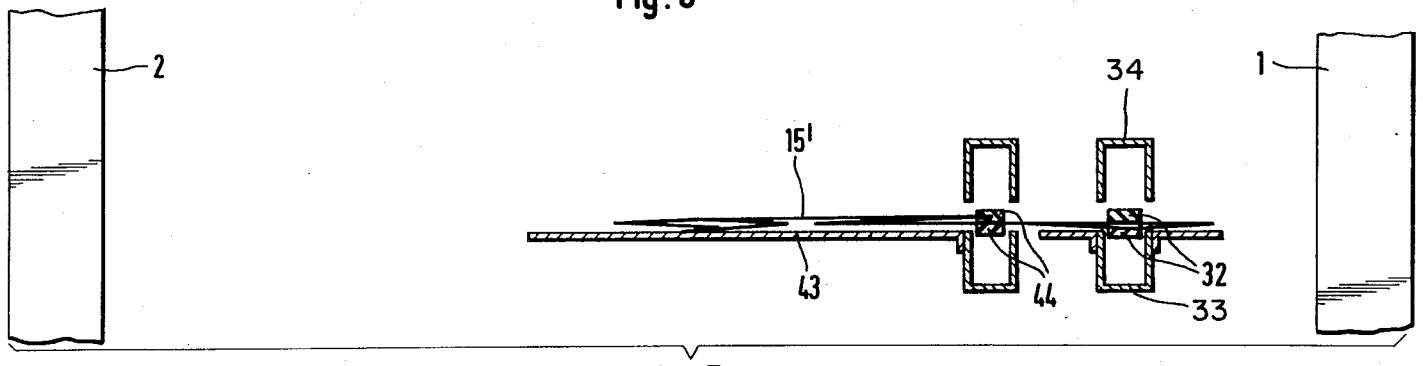
FIG. 7 is a section taken through the apparatus along the line VII—VII in FIG. 4.

The conveyor belts 31 and 32 receive the sack 15' delivered by the belts 19 and 20 and turned about the scoreline 16, with the pair of belts 31, as a result of directly adjoining the guide plate 24, receiving and clamping a portion of the sack that has been folded by the guide bar 27 about the folding edge 26, against an adjacent portion of the sack as is clearly shown in FIG. 6. FIG. 6 also shows that the pairs of conveyor belts, 31 and 32 are likewise covered by lower and upper housing portions 33 and 34.

Figure 2:
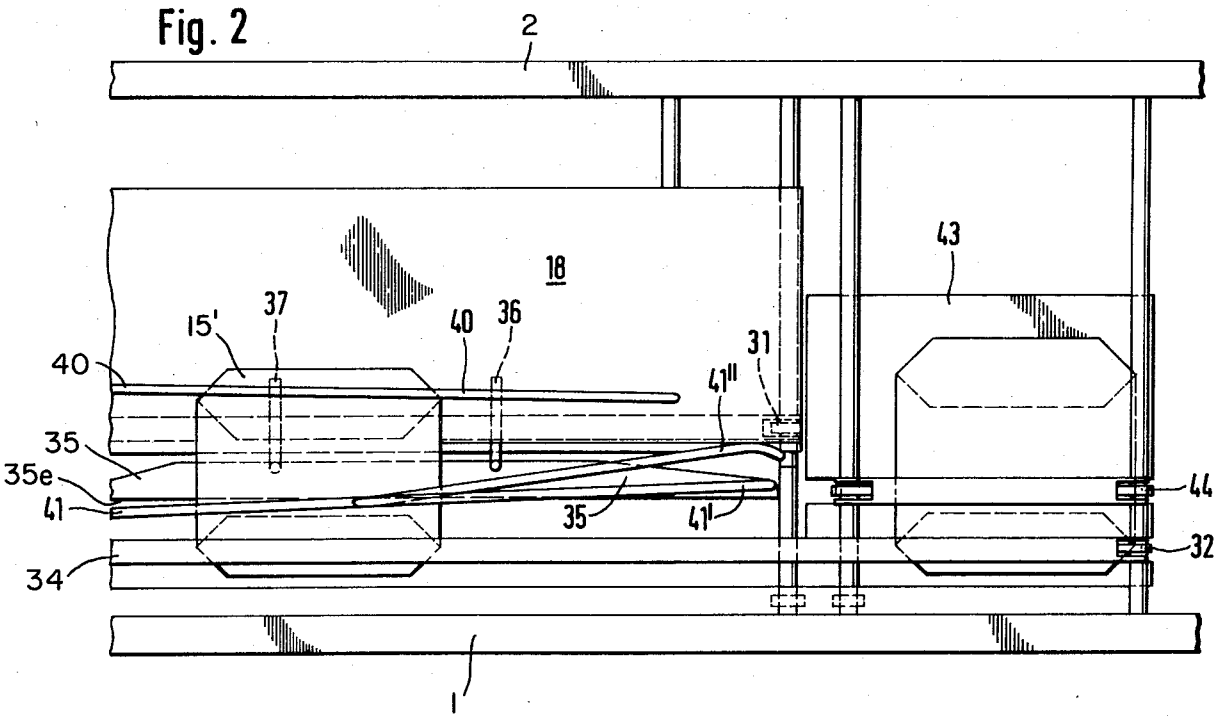

For the purpose of folding the sack 15' about the second scoreline 17 there is a folding blade 35 (FIG. 6) secured by holding rods 36 and 37 to a vertical wall depending from the guide table 18. To facilitate proper engagement of the sack 15' with an elongated folding edge 35*e* of the folding blade 35, the folding blade comprises a guide bar 38 at one end which has one end secured by way of an additional holding rod 39 to the guide table 18, namely below the latter. During further transport of the sack 15' through the pairs of conveyor belts 31 and 32, the portion of the sack resting on the guide table 18 is on the one hand guided by the guide bar 38 with its scoreline 17 towards the folding blade 35 and on the other hand pressed onto the guide table 18 by a cantilevered pressure bar 40 (FIGS. 1, 5 and 6) secured by one end to a support 40*s* (FIGS. 1, 3 and 5) on an inner one of the conveyor housing portions 30, so that this folds the sack for a second time, namely about the scoreline 17. This second folding operation is facilitated by a cantilevered retaining bar 41 which presses the sack in the region of the scoreline 17 about the folding edge of the folding blade 35, as is shown in FIG. 6. The retaining bar 41 is secured by one end to a support 42 on an outer one of the conveyor portions 30 whereas the other end is forked to produce furcations 41' and 41'', as shown in FIG. 2. While the furcation 41' assists in folding of the sack 15' by the folding blade 35 the furcation or secondary bar portion 41'' of the retaining bar 41 ensures that, after completion of the folding operation, the portion of the sack resting on the guide table 18 is pressed down onto a horizontal discharge table 43 adjoining the guide table 18, so that the folded sack can be taken away, on the one hand by the pair of conveyor belts 32 and on the other hand by a pair of discharge conveyor belts 44 adjoining the folding blade 35. If the furcation 41'' were not provided, the sack portion resting on the guide table 18 would not sufficiently rapidly fall onto the horizontal discharge table 43. The result of that would be that the sack 15' might not be engaged by the discharge conveyor belt pair 44.

It is of course possible to fold sacks 15 of other shapes or to vary the depth of the Z fold for any one size of sack. To achieve this, it is only necessary to adjust or set the scoring discs 13, 14, the pairs of conveyor belts 19, 20, 31 and 32, the guide plate 24, the folding blade 35 and the appropriate bars 27, 38, 40 and 41.

I claim:

1. Apparatus for folding an essentially planar article to a Z-shaped configuration, which comprises:

conveying means for conveying the essentially planar article along a predetermined path;

first folding means mounted adjacent the conveying means for folding a first portion of the essentially planar article in a first direction along a first fold line as the article is conveyed along the predetermined path by the conveying means; and second folding means mounted adjacent the conveying means for folding a second portion of the essentially planar article in a second opposite direction along a second fold line, which is spaced from the first fold line, as the article is conveyed along the predetermined path by the conveying means.

2. Apparatus as recited in claim 1, which further comprises:

first and second spaced scoring means mounted adjacent the conveying means for forming respective first and second spaced scorelines in the essentially planar article as the article is conveyed along the predetermined path by the conveying means, the first and second scorelines being formed to face in opposite directions and defining the first and second fold lines of the article, respectively.

3. Apparatus as recited in claim 2, in which:

the conveying means includes first conveyor means for engaging the essentially planar article adjacent opposite ends thereof and feeding the article through the first and second scoring means;

the conveying means further includes a second separate conveyor means which subsequently engages the essentially planar article on only one side of the first scoreline formed in the article by the first scoring means, for feeding the article through the first folding means, with the part of the article on an opposite side of the first scoreline being free to move transversely of the path of travel of the article as the first portion of the article is folded along the first scoreline by the first folding means; and a guide table is provided adjacent the second conveyor means and the first folding means for supporting a portion of the essentially planar article on the opposite side of the first scoreline as the first portion of the article is folded along the first scoreline by the first folding means.

4. Apparatus as recited in claim 1, in which:

the conveying means includes a conveyor means which engages the essentially planar article on only one side of the first fold line of the article, for feeding the article through the first folding means, with the part of the article on an opposite side of the first fold line being free to move transversely of the path of travel of the article as the first portion of the article is folded along the first fold line by the first folding means; and a guide table is provided adjacent the conveyor means and the first folding means for supporting a portion of the essentially planar article on the opposite side of the first fold line as the first portion of the article is folded along the first fold line by the first folding means.

5. Apparatus as recited in claim 4, in which:

at least a portion of the guide table is inclined and rises upward in the direction of conveying of the article.

6. Apparatus as recited in claim 4, in which:

the conveying means further includes a pair of opposed conveyors which receive therebetween superposed portions of the essentially planar article adjacent the first fold line of the article as the second portion of the article is folded along the second fold line of the article by the second folding means.

7. Apparatus as recited in claim 1, in which the first folding means includes:

an elongated folding member having an elongated folding edge extending in the direction of conveying of the essentially planar article; and an elongated folding bar extending from a position beneath a plane containing the folding edge, upward and above the folding edge, for engaging the essentially planar article and folding the first portion of the article about the folding edge along the first fold line.

8. Apparatus as recited in claim 7, in which the second folding means includes:

an elongated folding member having an elongated folding edge extending in the direction of conveying of the essentially planar article; and an elongated folding bar extending adjacent the folding edge for engaging and folding the article about the folding edge along the second fold line.

9. Apparatus as recited in claim 8, which further comprises:

guide means extending from a leading end of the elongated folding member of the second folding means at an angle across the path of travel of the essentially planar article, for guiding the second fold line of the article to the elongated folding edge of the elongated folding member.

10. Apparatus as recited in claim 4, in which:

the guide table also extends adjacent the second folding means; and an elongated pressure bar is mounted adjacent the guide table for urging a free outer portion of the essentially planar article toward the guide table as the second portion of the article is folded about the elongated folding edge of the second folding means by the second folding means.

11. Apparatus as recited in claim 10, in which;

a discharge table is mounted adjacent the second folding means for receiving the folded essentially planar article from the second folding means and the guide table;

the conveying means includes at least one pair of opposed discharge conveyors for receiving the folded essentially planar article therebetween from the guide table and feeding the article over the discharge table; and a guide means is provided for urging the free outer portion of the folded essentially planar article toward the discharge table to guide the folded article into the pair of opposed discharge conveyors.

12. Apparatus as recited in claim 11, in which:

the second folding means includes an elongated folding bar which is bifurcated at one end and which includes a projecting secondary bar portion which defines the guide means for urging the free outer portion of the folded essentially planar article toward the discharge table.

* * * * *